United States Patent [19]

Kimura et al.

[11] Patent Number: 4,636,649

[45] Date of Patent: Jan. 13, 1987

[54] PHOTOELECTRIC SMOKE SENSOR TERMINAL

[75] Inventors: Tetsuo Kimura, Tokyo; Seiichi Tanaka, Chiba; Takashi Suzuki, Tokyo, all of Japan

[73] Assignee: Nittan Company, Limited, Tokyo, Japan

[21] Appl. No.: 833,577

[22] Filed: Feb. 26, 1986

Related U.S. Application Data

[63] Continuation of Ser. No. 542,258, Oct. 14, 1983.

[30] Foreign Application Priority Data

Oct. 22, 1982 [JP] Japan ..... 57-158899[U]

[51] Int. Cl.[4] ..... G08B 17/10; G08B 26/00

[52] U.S. Cl. ..... 250/574; 340/505; 340/630

[58] Field of Search ..... 250/574; 340/505-508, 340/511, 630; 455/70

[56] References Cited

U.S. PATENT DOCUMENTS

| | | | |
|---|---|---|---|
| 3,316,410 | 1/1967 | Meili et al. | 250/218 |
| 4,103,337 | 7/1978 | Whiteside | 340/505 |
| 4,251,769 | 2/1981 | Ewert et al. | 340/511 |
| 4,260,981 | 4/1981 | Yamauchi et al. | 340/630 |
| 4,342,986 | 8/1982 | Buskirk et al. | 340/506 |
| 4,361,832 | 11/1980 | Cole | 340/506 |

*Primary Examiner*—David C. Nelms
*Assistant Examiner*—Stephone Allen
*Attorney, Agent, or Firm*—Hill, Van Stanten, Steadman & Simpson,

[57] ABSTRACT

A photoelectric smoke sensor terminal has an address signal detector for detecting whether or not an address assigned to the terminal coincides with an address represented by an address signal from a main unit. Only when the coincidence signal is supplied to a switch circuit is a photoelectric smoke sensor turned on. The terminal also has an item data memory for supplying item data (e.g. gas leakage and smoke generation data) so that a plurality of item data signals together with an output signal from the sensor can be transmitted on a single transmission line.

5 Claims, 2 Drawing Figures

PHOTOELECTRIC SMOKE SENSOR TERMINAL

This is a continuation of application Ser. No. 542,258, filed Oct. 14, 1983.

BACKGROUND OF THE INVENTION

The present invention relates to a sensor terminal and, more particularly, to a photoelectric smoke sensor terminal for converting an analog output signal from a photoelectric smoke sensor to a digital signal and for transmitting the digital signal to a main unit (receiver side) only when an address of the terminal is accessed by the main unit.

In a conventional terminal of this type, a photoelectric smoke sensor is coontinuously operated to supply an analog detected signal to an A/D converter. When an address of this terminal is accessed by a main unit, the converted digital signal is supplied from the A/D converter to the main unit. Therefore, a light-emitting element of the smoke sensor is normally ON, and light is constantly received by a light-receiving sensor and is transduced to an electrical signal, thus resulting in high power consumption.

In order to eliminate this drawback, a smoke sensor terminal having a pulse generator is proposed. A light-emitting element is intermittently turned on in response to an output from the pulse generator. The light from the light-emitting element is received by a light-receiving element. The light-receiving element converts light received to an electrical signal in accordance with the intensity thereof. This analog electrical signal is latched and converted to a digital signal, or is converted to a digital signal which is then latched. The latched digital signal is sent to the main unit when the main unit accesses this terminal. However, since the terminal of this type requires a pulse generator, a latch circuit and the like, the terminal configuration becomes complex and the terminal as a whole becomes expensive.

SUMMARY OF THE INVENTION

It is, therefore, an object of the present invention to provide a photoelectric smoke sensor terminal which eliminates the conventional drawbacks such as high power consumption and the requirement of a pulse generator or the like.

In order to achieve the above object of the present invention, there is provided a photoelectric smoke sensor terminal having a photoelectric smoke sensing means, a light-emitting element, and a light-receiving element for converting light to an analog electrical signal. An amplifier is connected to the light-receiving element for amplifying the analog electrical signal from the light-receiving element. An A/D converter is provided for converting the amplified analog electrical signal from the photoelectric smoke sensing means to a digital signal. An item data memory is provided for storing item data. An address signal detector is connected to the A/D converter and the item data memory for detecting whether or not an address assigned to the photoelectric smoke sensor terminal coincides with an address represented by an address signal from a main control unit, and for supplying a coincidence signal to the A/D converter and the item data memory. A transmission circuit is connected to the A/D converter, the address signal detector, and the item data memory for transmitting the digital signal indicating an operation state of the photoelectric smoke sensing means onto a transmission line in response to the coincidence signal from the address signal detector. The transmission circuit transmits a digital signal from the A/D converter along with a corresponding item data from the item data memory in response to the coincidence signal from the address signal detector, and receives the address signal from the main unit and supplies the address signal to the address signal detector. A switch circuit is connected to the light-emitting element and the address detector for operating the light-emitting element only in response to the coincidence signal.

DETAILED DESCRIPTION OF THE PREFERRED EMBODIMENT

Figure 1:
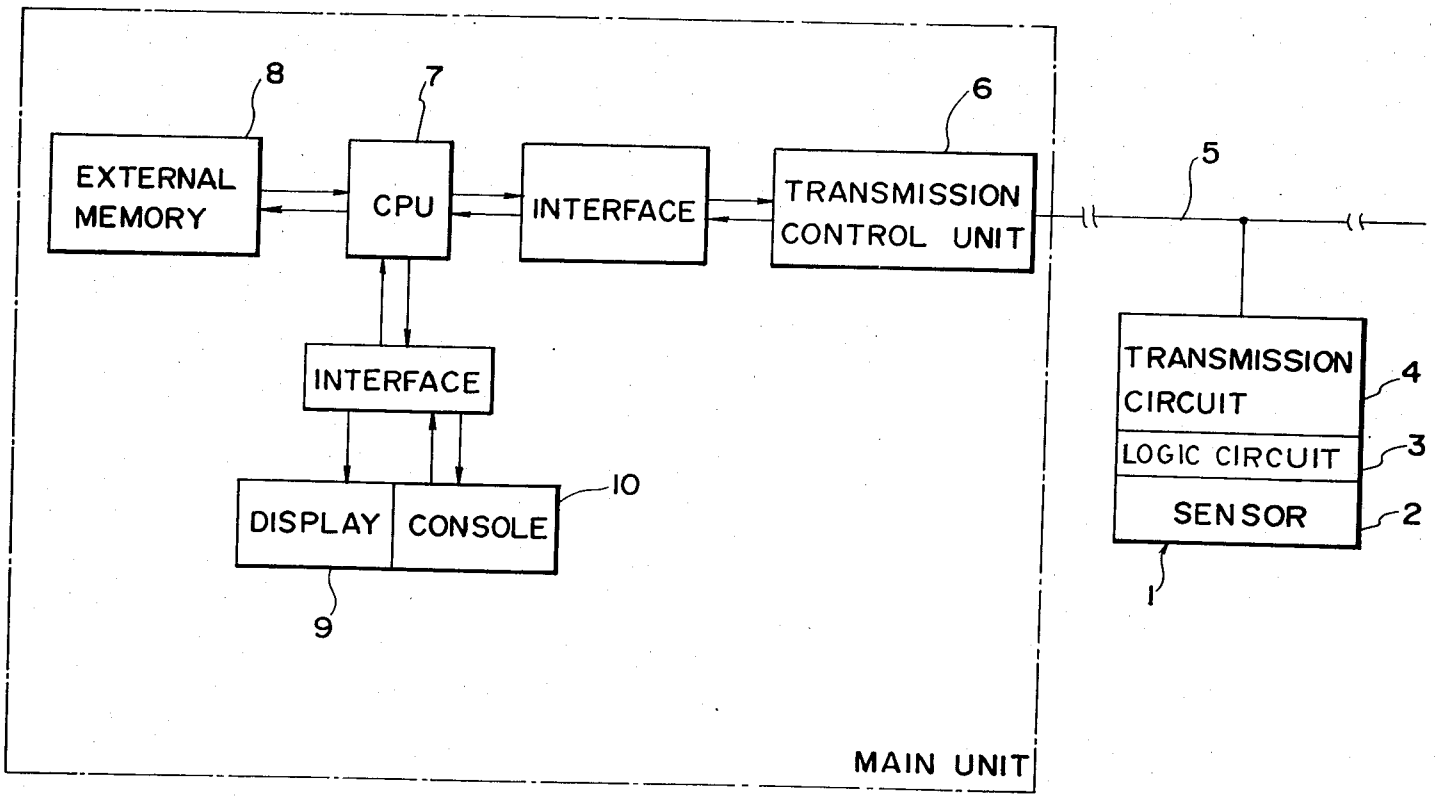
FIG. 1 is a block diagram of an alarm polling system of the prior art to which the present invention is applied.

In order to best understand the photoelectric smoke sensor terminal according to an embodiment of the present invention, an alarm polling system to which the present invention is applied will be described. FIG. 1 is a block diagram of the alarm polling system. A plurality of terminals 1 are connected to a transmission control unit 6 and a main unit through a transmission line 5. Each terminal 1 comprises a photoelectric smoke sensor 2; a logic circuit section 3 including an A/D converter, an address signal detector and the like; a transmission circuit 4 serving as an interface between input/output signals of the logic circuit section 3 and signals on the transmission line 5; and so on. The transmission control unit 6 performs parallel and logic conversion of serial data. The main unit includes a central processing unit (CPU) 7, an external memory 8, a display 9 for displaying the processed results, a console 10 for entering commands in the CPU 7, interfaces between these component parts, and so on. The main unit cyclically generates address signals corresponding to the respective terminals. When a given terminal is accessed, this terminal sends back a digital signal from its smoke sensor to the main unit. Therefore, when the main unit monitors the level of the digital signal from the given terminal, a fire can be properly detected. It is also possible to access a specific terminal upon command entry at the console 10.

Figure 2:
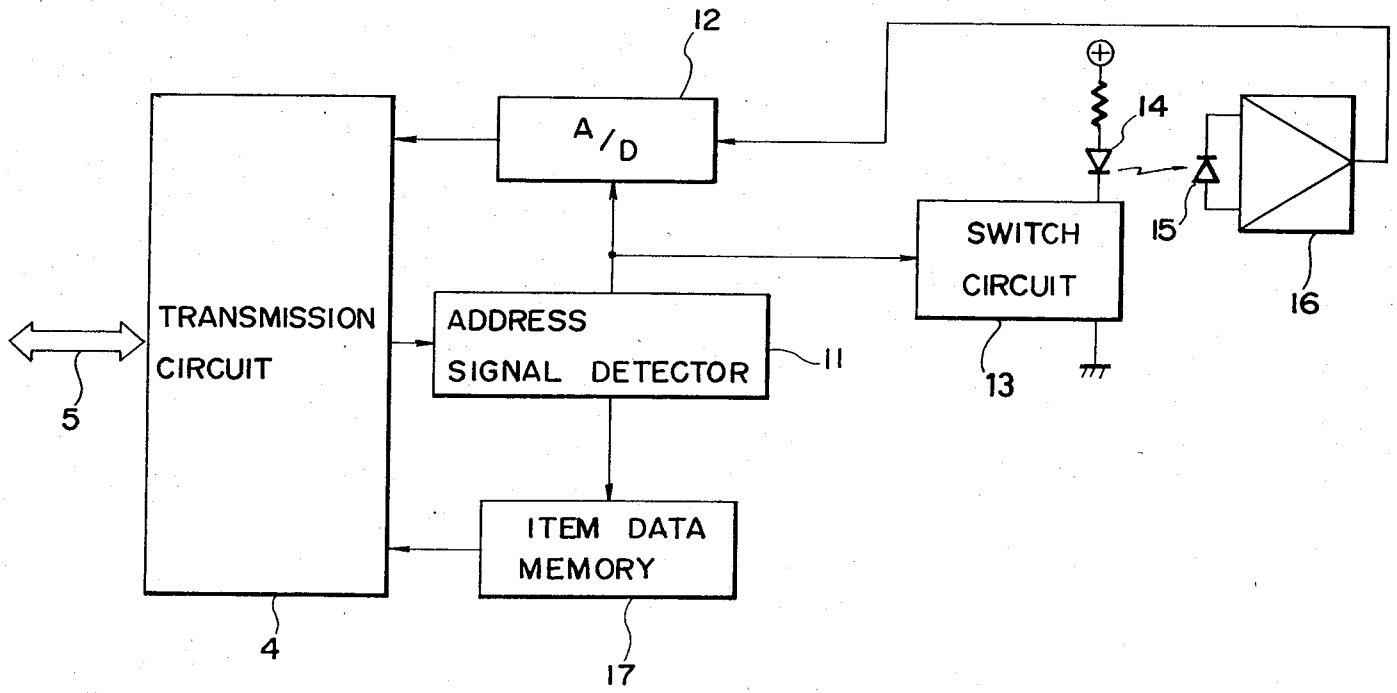
FIG. 2 is a block diagram of a photoelectric smoke sensor terminal according to an embodiment of the present invention.

FIG. 2 is a block diagram of a photoelectric smoke sensor terminal 1 according to the embodiment of the present invention. A transmission circuit 4 is connected to the transmission line 5 to transmit an address signal from the main unit to an address signal detector 11. The transmission circuit 4 and address signal detector 11 are provided in the preferred embodiment by Fuji Electric Co., Ltd. integrated circuit type EWD 106. A digital signal from an A/D converter 12 is converted by the transmission circuit 4 to serial data. The serial data is then transmitted onto the transmission line 5. When the input signal to the address signal detector 11 indicates a corresponding address (address assigned to the terminal in which this address signal detector 11 is included), the detected signal is supplied to a switch circuit 13 and the A/D converter 12. The switch circuit 13 is connected in series with a light-emitting diode 14 of the photoelectric smoke sensor and is turned on in response to the output signal from the address signal detector 11.

In operation, the switch circuit 13 is turned on in response to the output signal from the address signal detector 11, so that the light-emitting diode 14 is turned on and a light-receiving element 15 receives a light beam corresponding to a smoke concentration. The light beam is then converted by the light-receiving element 15 to an analog electrical signal. This analog signal is amplified by an amplifier 16. An amplified signal from the amplifier 16 is converted by the A/D converter 12 to a digital signal. The A/D converter 12 has already received the output signal from the address signal detector 11, so that the digital signal is transmitted onto the transmission line through the transmission circuit 4. When the main unit receives the signal transmitted in response to the address signal, the main unit determines the occurrence or absence of a fire. When item data indicating gas leakage, fire occurrence, smoke generation and so on are stored in an item data memory 17, corresponding item data is added to the data transmitted from the terminal to the main unit. Therefore, different data can be transmitted on the single transmission line 5 for discrimination at the main unit. Furthermore, according to the present invention, a current flows through the light-emitting diode 14 only when the address signal detector 11 detects that the address assigned to the corresponding terminal coincides with the address represented by the address signal transmitted from the main unit, thereby greatly decreasing power consumption. For this reason, no pulse generator or the like need be arranged in the terminal of this embodiment, resulting in simple construction and low cost. The photoelectric smoke sensor may comprise a light-scattering sensor or a light-attenuation sensor, or a mixture thereof. When a light-scattering sensor and a light-attenuation sensor are used together, item data for these sensors must be stored in the item data memory 17.

According to the embodiment described above, each light-emitting element is turned on only when the address of the corresponding terminal is accessed, so that power consumption of each terminal can be decreased. Furthermore, no pulse generator or the like need be used, and simple construction is obtained at low cost.

Although various minor changes and modifications might be proposed by those skilled in the art, it will be understood that we wish to include within the claims of the patent warranted hereon all such changes and modifications as reasonably come within our contribution to the art.

We claim as our invention:

1. A photoelectric smoke sensor terminal for use with a main control unit which addresses the terminal via a transmission line, comprising:

photoelectric smoke sensing means utilizing light-emitting means and a corresponding light-receiving means for converting light to an analog electrical signal responsive to the presence of smoke;

an amplifier means connected to said light-receiving means for amplifying the analog electrical signal from said light-receiving means;

an A/D converter means for converting the amplified analog electrical signal from said photoelectric smoke sensing means to a digital signal;

an address signal detector means connected to said A/D converter means for detecting whether or not an address assigned to and stored at the photoelectric smoke sensor terminal coincides with an address represented by an address signal contained in a series of address signals received from the main control unit and for supplying a coincidence signal indicative of the coincidence of the stored and received addresses to said A/D converter means so as to activate the same for output of the digital signal created when said light-emitting means is operated;

a transmission means connected to said A/D converter means and said address signal detector means for transmitting the digital signal indicating an operation state of said photoelectric smoke sensing means onto the transmission line when it is received in response to the coincidence signal from said address signal detector means and for receiving the address signal from the main unit and supplying the address signal to said address signal detector means; and a switch circuit means connected to said light-emitting means and controlled by an output of said address signal detector means for operating said light-emitting means and creating said analog signal converted to a digital signal only in response to the coincidence signal, whereby power drain supplied to the sensor terminal is minimized.

2. A terminal according to claim 1 further comprising an item data memory means for storing item data connected to the address signal detector means and to said transmission means, the item data being transmitted to said transmission means in response to the coincidence signal from said address signal detector means.

3. A terminal according to claim 2 wherein the item data includes gas leakage and smoke generation data so that such data indicating different modes of operation are transmitted on the transmission line.

4. In a photoelectric smoke sensor terminal for use with a main control unit which addresses the terminal via a transmission line and wherein the remote terminal has an A/D converter means for converting amplified analog electrical signals from the photoelectric smoke sensing means to a digital signal, an address signal detector means connected to the A/D converter means for detecting whether or not an address assigned to and stored at the photoelectric smoke sensor terminal coincides with an address represented by an address signal contained in a series of address signals received from the main control unit, and a transmission means connected to the A/D converter means and the address signal detector means for transmitting the digital signal indicating an operation state of the photoelectric smoke sensing means onto the transmission line and for receiving the address signal from the main unit and supplying the address signal to said address signal detector means, wherein the improvement comprises:

the address signal detector means supplying a coincidence signal indicative of the coincidence of the stored and received addresses to said A/D converter means when the terminal has been addressed so as to activate the A/D converter means and transmit the digital signal;

the photoelectric smoke sensing means utilizing a light-emitting means and a corresponding light-receiving means for converting light to an analog electrical signal responsive to the presence of smoke; and a switch circuit means connected to the light-emitting means in response to an output signal from the address detector means for operating said light-emitting means only in response to the coincidence signal and when the A/D converter means is being activated by the coincidence signal, whereby power supplied to the sensor terminal is minimized.

5. A terminal according to claim 4 wherein said circuit means is operative to connect one end of the light-emitting diode so as to permit current flow through the diode.

* * * * *